US009978506B2

(12) United States Patent
Ohtsubo et al.

(10) Patent No.: US 9,978,506 B2
(45) Date of Patent: May 22, 2018

(54) COIL COMPONENT AND METHOD FOR MANUFACTURING SAME

(71) Applicant: Panasonic Intellectual Property Management Co., Ltd., Osaka (JP)

(72) Inventors: Mutsuyasu Ohtsubo, Hyogo (JP); Ikuya Wakamori, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days. days.

(21) Appl. No.: 15/300,017

(22) PCT Filed: Jun. 30, 2015

(86) PCT No.: PCT/JP2015/003277

§ 371 (c)(1),
(2) Date: Sep. 28, 2016

(87) PCT Pub. No.: WO2016/006200

PCT Pub. Date: Jan. 14, 2016

(65) Prior Publication Data

US 2017/0186531 A1 Jun. 29, 2017

(30) Foreign Application Priority Data

Jul. 7, 2014 (JP) ..... 2014-139316

(51) Int. Cl.
*H01F 27/02* (2006.01)
*H01F 27/06* (2006.01)
(Continued)

(52) U.S. Cl.
CPC ..... *H01F 27/29* (2013.01); *H01F 27/255* (2013.01); *H01F 27/2823* (2013.01); *H01F 41/0246* (2013.01); *H01F 41/10* (2013.01)

(58) Field of Classification Search
CPC ..... H01F 27/292; H01F 27/02; H01F 27/29; H01F 27/306; H01F 27/24; H01F 41/10
(Continued)

(56) References Cited

U.S. PATENT DOCUMENTS 3,663,914 A * 5/1972 Lane ..... H01F 5/04 336/192
3,963,857 A * 6/1976 Reynolds ..... H01F 5/04 174/84 C
(Continued)

FOREIGN PATENT DOCUMENTS

CN 102290194 A 12/2011
CN 102290208 A 12/2011
(Continued)

OTHER PUBLICATIONS

International Search Report of PCT application No. PCT/JP2015/003277 dated Sep. 15, 2015.
(Continued)

*Primary Examiner* — Tsz Chan
(74) *Attorney, Agent, or Firm* — McDermott Will & Emery LLP

(57) ABSTRACT

A coil component of the present invention includes a magnetic core containing magnetic powder, a coil element embedded in the magnetic core and having an end projecting from the magnetic core, and a retaining member for retaining the end of the coil element. The retaining member has a main surface having a recess therein sinking toward the magnetic core. The retaining member has a ridge projecting from a bottom surface of the recess and extending linearly along the bottom surface. The ridge has a portion that intersects with the end of the coil element. The portion of the ridge is welded to the end of the coil element.

16 Claims, 9 Drawing Sheets

(51) Int. Cl.

| | |
|---|---|
| ***H01F 27/29*** | (2006.01) |
| ***H01F 5/00*** | (2006.01) |
| ***H01F 17/04*** | (2006.01) |
| ***H01F 27/28*** | (2006.01) |
| ***H01F 27/255*** | (2006.01) |
| ***H01F 41/02*** | (2006.01) |
| ***H01F 41/10*** | (2006.01) |

(58) Field of Classification Search
USPC ..... 336/65, 83, 90, 192, 200, 221, 232
See application file for complete search history.

(56) References Cited

U.S. PATENT DOCUMENTS 4,106,836 A * 8/1978 Asick ..... H01R 4/2495 439/422
2011/0260821 A1 10/2011 Yamada et al.
2012/0188045 A1 7/2012 Yamada et al.
2014/0090235 A1 4/2014 Yamada et al.

FOREIGN PATENT DOCUMENTS

JP 2003-022916 1/2003
JP 2011-249770 12/2011
JP 2012-195399 10/2012
JP 2013-045871 3/2013
JP 2013045871 A * 3/2013
JP 2013-191726 9/2013
JP 5877296 B2 3/2016

OTHER PUBLICATIONS

English Translation of Chinese Search Report dated Jan. 5, 2018 for the related Chinese Patent Application No. 201580019271.4.

* cited by examiner

COIL COMPONENT AND METHOD FOR MANUFACTURING SAME

This application is a U.S. national stage application of the PCT international application No. PCT/JP2015/003277 filed on Jun. 30, 2015, which claims the benefit of foreign priority of Japanese patent application No. 2014-139346 filed on Jul. 7, 2014, the contents all of which are incorporated herein by reference.

TECHNICAL FIELD

The present invention relates to a coil component used for various electronic devices, and a method for manufacturing the coil component.

BACKGROUND ART

In recent years, electronic components have been required to have small sizes and used with large currents as performance of electronic devices is highly developed. The electronic components include a coil component.

FIG. 17 is a perspective view of conventional coil component 5. Conventional coil component 5 includes coil element 1 made of an insulation-coated copper wire which is wound. An end of coil element 1 is welded to retaining members 3. Coil element 1 and retaining member 3 are pressure-molded integrally with mixed powder containing metallic magnetic powder and binding agent containing thermosetting resin, and partially embedded in magnetic core 2. Terminal 4 is formed by bending the end of coil element 1 and a portion of retaining member 3 projecting from a side surface of magnetic core 2.

PTL 1 is known as a prior art document relating to this application.

CITATION LIST

Patent Literature

PTL 1: Japanese Patent Laid-Open Publication No. 2013-191726

SUMMARY

In order to provide coil component 5 shown in FIG. 17 with a small size, retaining member 3 has a small size. However, it is necessary to reduce the thickness of retaining member 3 to provide retaining member 3 with a small size. If the thickness is reduced, retaining member 3 may be distorted at welding. For instance, when retaining member 3 is welded to the end of coil element 1, retaining member 3 has a distortion. Especially, a resistance welding may cause a large distortion in retaining member 3. In the resistance welding, welding electrodes sandwich the end of coil element 1 and retaining member 3 between the electrodes to press. When the welding electrodes apply a pressure, retaining member 3 is elongated in a direction perpendicular to a direction in which the end of coil element 1 extends, thereby causing distortion. The distortion of retaining member 3 may be an obstacle for a metallic mold to perform proper molding when a magnetic material and retaining member 3 are pressure molded. Alternatively, it may be considered to increase a clearance of a metallic mold, but the consideration is undesirable because a leak of magnetic materials occurs at the pressure molding, and thus causes deterioration in productivity.

In view of the above problem in conventional coil component 5, a coil component according to the present invention includes a magnetic core containing binding agent and magnetic powder mixed into the binding agent, a coil element embedded in the magnetic core, and a retaining member for retaining an end of the coil element. The end of the coil element projects from the magnetic core. The retaining member has a recess therein sinking toward the magnetic core. The retaining member has a ridge projecting from a bottom surface of the recess and extending linearly along the bottom surface. The ridge has a portion intersecting with the end of the coil element, and is welded to the end of the coil element at the portion.

The above configuration prevents distortion from occurring in the retaining member, and provides the coil component with high productivity even if the coil component has a small size.

DETAIL DESCRIPTION OF PREFERRED EMBODIMENTS

Exemplary Embodiment 1

Figure 1:
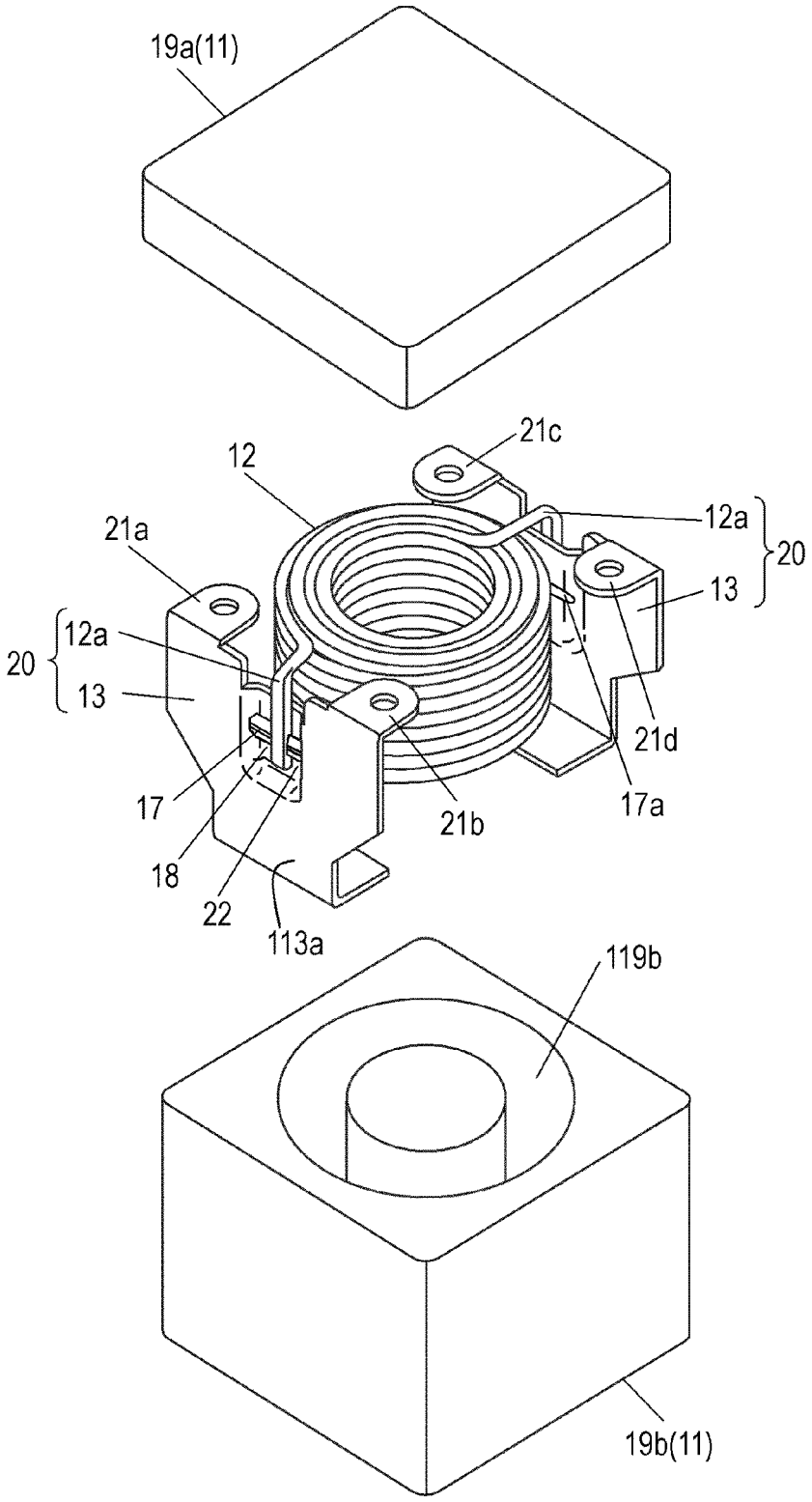
FIG. 1 is an exploded perspective view of a coil component in accordance with an exemplary embodiment of the present invention.

FIG. 1 is an exploded perspective view of coil component 10 in accordance with Exemplary Embodiment 1.

Coil component 10 in accordance with the present embodiment includes magnetic core 11 containing metallic magnetic powder and binding agent containing thermosetting resin, coil element 12 formed by winding a lead wire helically, and retaining member 13 for electrically connecting to an external terminal. A winding part of coil element 12 is embedded in magnetic core 11 while and end 12*a* of coil element 12 is exposed from magnetic core 11. End 12*a* of coil element 12 is electrically connected to retaining member 13 by welding. Retaining member 13 is partially embedded and fixed in magnetic core 11.

Figure 2:
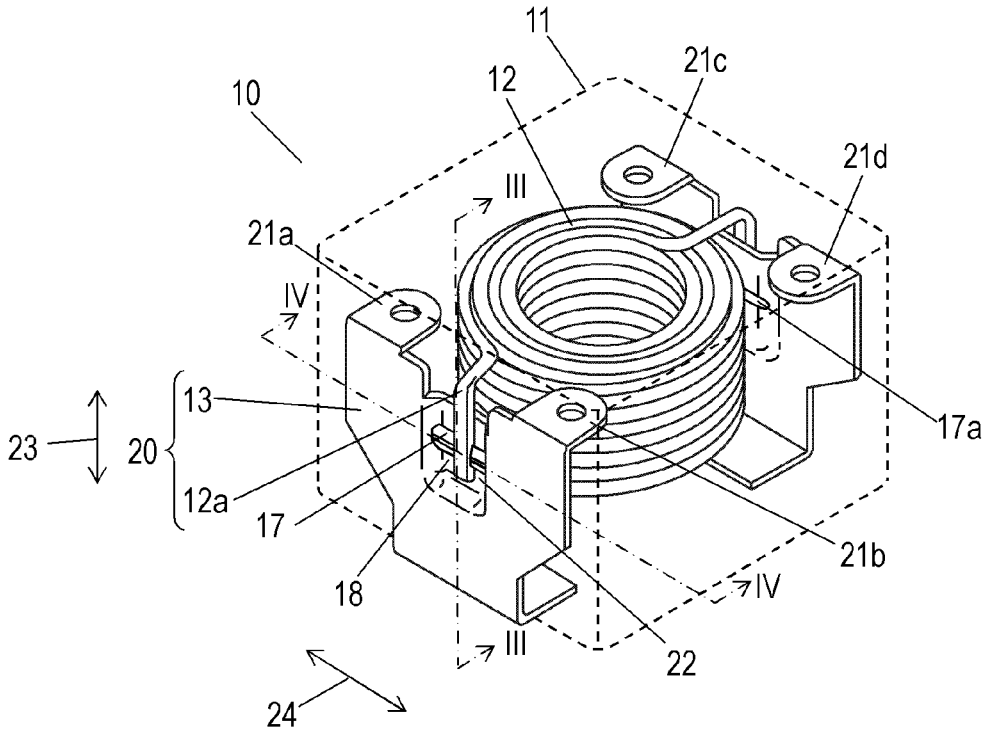
FIG. 2 is a perspective view of the coil component in accordance with the embodiment.
Figure 3:
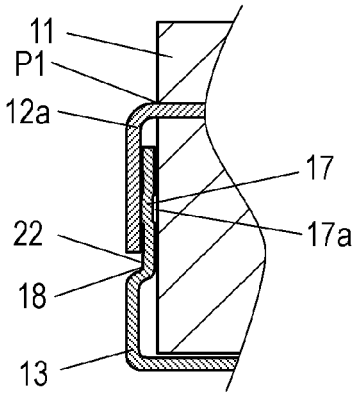
FIG. 3 is a cross-sectional view of the coil component along line III-III shown in FIG. 2.
Figure 4:
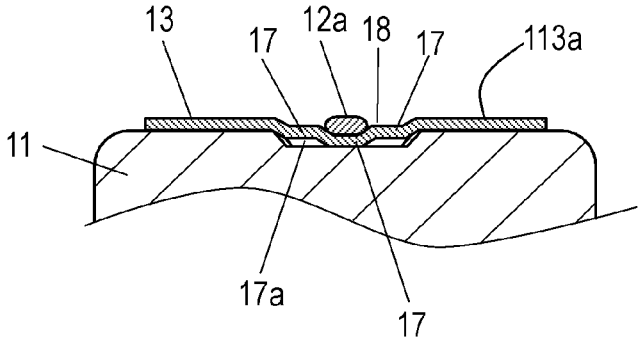
FIG. 4 is a cross-sectional view of the coil component along line IV-IV shown in FIG. 2.
Figure 5:
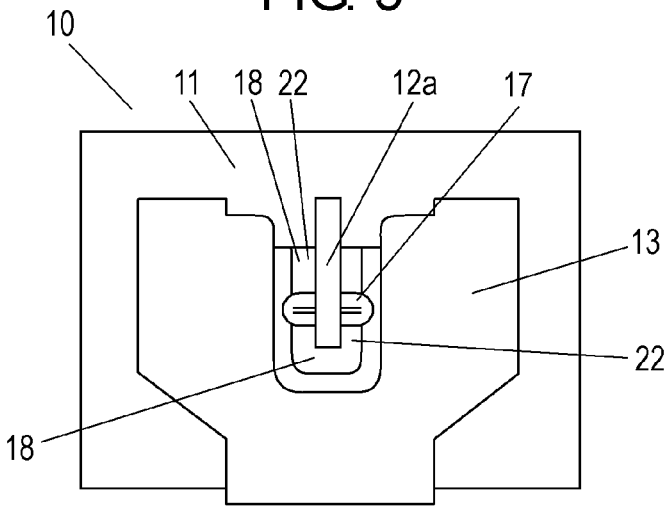
FIG. 5 is a side view of the coil component shown in FIG. 2 for illustrating a retaining member.

FIG. 2 is a perspective view of coil component 10 seeing through magnetic core 11. The outline of magnetic core 11 is illustrated by the broken line. FIG. 3 is a cross-sectional view of coil element 12 along line III-III shown in FIG. 2 in which retaining member 13 is welded to end 12*a* of coil element 12. FIG. 4 is a cross-sectional view of the coil component along line IV-IV shown in FIG. 2 for illustrating retaining member 13 welded to end 12*a* of coil element 12. FIG. 5 is a side view of the coil component shone in FIG. 2 for illustrating retaining member 13.

Magnetic core 11 shown in FIG. 2 includes pressurized powder body 19*a* and pressurized powder body 19*b* shown in FIG. 1.

The binding agent containing thermosetting resin is mixed with metallic magnetic powder while the thermosetting resin is not fully cured, and pressure molded at a molding pressure of about 1 ton/cm$^2$ to form pressurized powder body 19*a* and pressurized powder body 19*b*.

Pressurized powder body 19*b* has a rectangular columnar shape having therein accommodating part 119*b* for accommodating coil element 12 therein. Pressurized powder body 19*a* has a lid shape to be put on pressurized powder body 19*b*. Coil element 12 is accommodated in accommodating part 119*b* serving as a hollow provided in pressurized powder body 19*b*. Pressurized powder bodies 19*a* and 19*b* are pressure molded again while coil element 12 is disposed between pressurized powder body 19*a* and pressurized powder body 19*b*, thereby providing magnetic core 11. At this moment, the second pressure molding is carried out at a molding pressure of about 5 ton/cm$^2$ which is larger than the molding pressure at the first pressure molding. The thicknesses of pressurized powder body 19*a* and pressurized powder body 19*b* after the second pressure molding is smaller than thicknesses of pressurized powder body 19*a* and pressurized powder body 19*b* before the second pressure molding. That is, the density of pressurized powder body 19*a* and pressurized powder body 19*b* after the second pressure molding is larger than the density of pressurized powder body 19*a* and pressurized powder body 19*b* before the second pressure molding. The second pressure molding allows coil element 12 to be embedded in pressurized powder body 19*a* and pressurized powder body 19*b*, thereby providing magnetic core 11 in which end 12*a* of the coil element 12 and retaining member 13 project from the boundary between pressurized powder body 19*a* and pressurized powder body 19*b*. Subsequently, the thermosetting resin contained in magnetic core 11 is fully cured by heat-treatment.

Coil element 12A is formed by winding a copper wire with a surface coated with insulation to have a coil form. In accordance with the embodiment, coil element 12 has a diameter of 0.3 mm. The insulation coating the surface of end 12*a* of coil element 12 is removed previously by the time when end 12*a* is electrically connected to ridge 17 by welding described later. End 12*a* of coil element 12 is pressed to have a flat shape with a thickness of about 0.2 mm.

In accordance with the embodiment, a copper plate with a thickness of about 0.15 mm is punched to form retaining member 13. Two retaining members 13 extending along two side surfaces of magnetic core 11 opposite to each other are bent along a lower surface of the magnetic core 11. One retaining member 13 out of two retaining members 13 has projecting portions 21*a* and 21*b* projecting from both sides of an end of retaining member 13. Another retaining member 13 out of two retaining members 13 has projecting portions 21*c* and 21*d* projecting from both sides of an end of retaining member 13. Projecting portions 21*a*, 21*b*, 21*c*, and 21*d* are embedded and fixed in magnetic core 11.

A surface of retaining member 13 projecting from magnetic core 11 may be coated with solder by solder dipping, if necessary. Retaining member 13 constitutes terminal part 20 together with end 12*a* of coil element 12, and is connected to an external terminal.

Retaining member 13 has recess 18 therein. Recess 28 is formed such that an area of retaining member 13 including a portion of retaining member 13 where retaining member 13 and end 12*a* of coil element 12 overlap sinks toward magnetic core 11 from the remaining area of retaining member 13. Retaining member 13 has main surface 113*a* having recess 18 formed therein. In accordance with the embodiment, a depth of recess 18 is about 0.2 mm. Retaining member 13 has ridge 17 projecting from bottom surface 22 of recess 18.

As shown in FIG. 5, ridge 17 extends linearly as to intersect with an extending direction in which end 12*a* of coil element 12 extends. Recess 18 is embossed from a back surface of recess 22 opposite to bottom surface 22 to form ridge 17. Upon being welded by resistance welding while ridge 17 intersects with end 12*a* of coil element 12, ridge 17 is electrically connected to end 12*a* of coil element 12 by the welding.

A length of ridge 17 is larger than a width of end 12*a* of coil element 12. In accordance with the embodiment, ridge 17 has a height of 0.1 mm projecting from bottom surface 22.

According to the embodiment, as shown in FIGS. 2 and 3, recess 18 is embossed from the back surface of recess 18 opposite to bottom surface 22 to form ridge 17. Groove 17*a* is formed in the back surface of ridge 17 along the shape of ridge 17 by the embossing. Since groove 17*a* extends along the shape of ridge 17 in the back surface of ridge 17, welding pressure easily distorts and crushes ridge 17 when ridge 17 is welded to end 12*a* of coil element 12 by resistance welding. This prevents projecting portions 21*a*, 21*b*, 21*c*, and 21*d* from expanding in direction 24 of retaining member 13, thereby reducing a clearance between a die and retaining member 13.

As a result, even if being made of soft material with high conductivity, such as copper, retaining member 13 can be thin, thereby providing coil component 10 with a small size.

Direction 23 shown in FIG. 2 is perpendicular to the lower surface of coil component 10 (magnetic core 11) while direction 24 is parallel to the lower surface of coil component 10 and the side surface of magnetic core 11 accommodating retaining member 13.

According to the embodiment, a cross section of ridge 17 in a direction perpendicular to the direction in which ridge 17 extends preferably has a projection shape tapering from a root portion to a tip end of ridge 17. The cross section of ridge 17 preferably has, e.g. a triangular shape, a circular arc shape, and a trapezoidal shape. The above shape of ridge 17 allows a current to concentrate and flow into a top of ridge 17 when ridge 17 is welded by resistance welding. Therefore, end 12*a* of coil element 12 can be welded to retaining member 13 stably.

According to the embodiment, when retaining member 13 is distorted, projecting portions 21*a* and 21*b* may be distorted in direction 24 in which the projecting portions are separated from each other and caught by a die at the second pressure welding. Further, projecting portions 21*c* and 21*d* may be distorted similarly. To solve this problem, ridge 17 has the projecting cross section, and extends linearly in the direction in which ridge 17 intersects with end 12*a* of coil element 12. Thus, a direction of stress crushing and widening ridge 17 can be directed in direction 23. This configuration easily elongates ridge 17 in direction 23, and prevents projecting portions 21*a*, 21*b*, 21*c*, and 21*d* of retaining member 13 from being distorted in direction 24.

Accordingly, ridge 17 intersecting perpendicularly with end 12*a* of coil element 12 in the direction in which end 12*a* of coil element 12 extends further prevents projecting portions 21*a*, 21*b*, 21*c*, and 21*d* of retaining member 13 from being distorted in the direction 24.

As shown in FIG. 4, in accordance with the embodiment, ridge 17 projecting from bottom surface 22 of recess 18 is provided in recess 18.

Since ridge 17 is provided in recess 18, the distortion caused when ridge 17 deforms can hardly transmit to main surface 113*a* of the retaining member 13 around recess 18.

Further, the height of ridge 17 projecting from bottom surface 22 of recess 18 may be not larger than two thirds of the depth of recess 18. This configuration prevents the distortion caused when ridge 17 deforms from transmitting to main surface 113*a* of the retaining member 13.

Exemplary Embodiment 2

Figure 6:
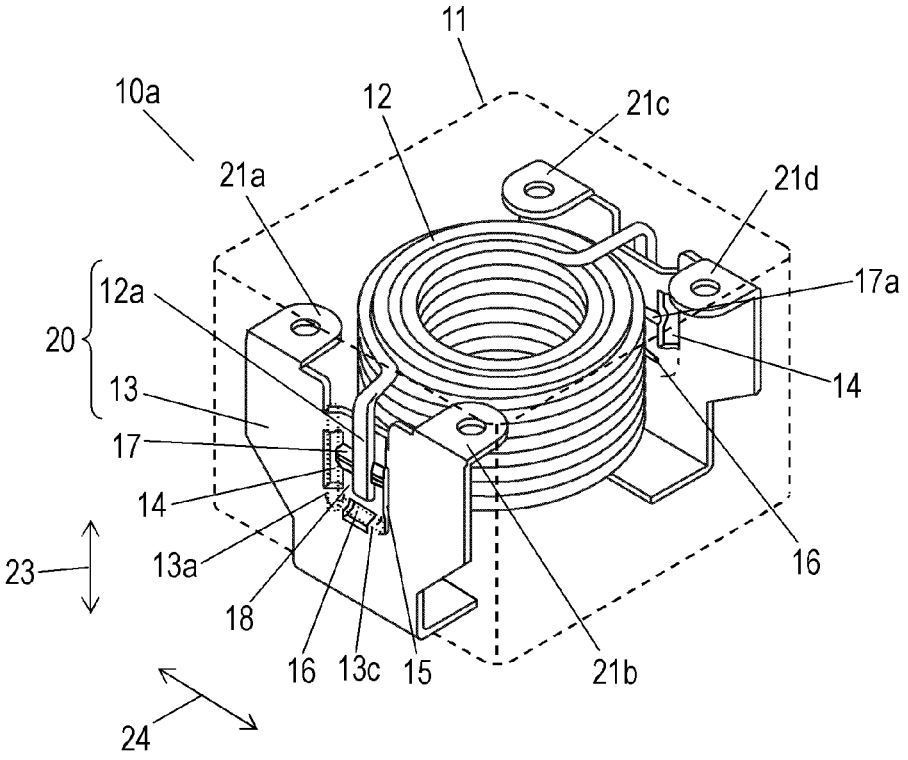
FIG. 6 is a perspective view of a coil component in accordance with Exemplary Embodiment 2.
Figure 7:
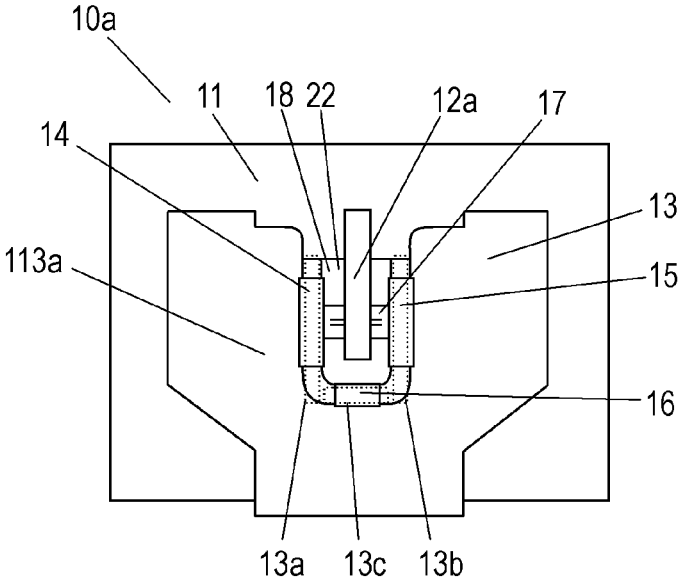
FIG. 7 is a side view of the coil component shown in FIG. 6 for illustrating a retaining member.

FIG. 6 is a perspective view of coil component 10*a* in accordance with Exemplary Embodiment 2. A broken line in FIG. 6 denotes the outline of magnetic core 11. FIG. 7 is a side view of the coil component for showing retaining member 13 shown in FIG. 6.

In FIGS. 6 and 7, components identical to those of coil component 10 according to Embodiment 1 shown in FIGS. 1 to 5 are denoted by the same reference numerals.

As shown in FIG. 7, in coil component 10*a*, retaining member 13 has slits 14 slit 15 passing through retaining member 13. End 12*a* of coil element 12 and ridge 17 are disposed between slits 14 and 15.

Since end 12*a* of coil element 12 and ridge 17 are disposed between slits 14 and 15, coil component 10*a* reduces stress which is caused when retaining member 13 is welded to end 12*a* of coil element 12 by resistance welding and which transmits in direction 24 of retaining member 13. In coil component 10*a* according to the present embodiment, slit 14 and slit 15 have longer sides parallel to each other, and have rectangular shapes having lengths in direction 23 of about 1.2 mm and lengths in direction 24 of about 0.3 mm. A distance between slit 14 and slit 15 is about 1 mm.

Retaining member 13 further has slit 16 passing through retaining member 13. Slit 16 is provided in an area which is between slit 14 and slit 15 and which extends in a direction in which end 12*a* of coil element 12 extends. Slit 16 is provided in the area extending in the direction in which end 12*a* of coil element 12 extends. Slit 16 reduces the distortion of retaining member 13 in direction 23 which is caused when retaining member 13 is welded to end 12*a* of coil element 12 by resistance welding.

In accordance with the present embodiment, slit 16 has a rectangular shape having a length in direction 24 of about 0.6 mm and a length in direction 23 of about 0.3 mm. A distance between slit 16 and slit 14 and a distance between slit 16 and slit 15 are about 0.5 mm.

As shown in FIG. 7, retaining member 13 has step portion 13*a* (inside an area surrounded by a broken line), step portion 13*b* (inside an area surrounded by a broken line), and step portion 13*c* (inside an area surrounded by a broken line) which are connected to main surface 113*a* of retaining member 13 and bottom surface 22 of recess 18. Step portions 13*a*, 13*b* and 13*c* constitute a step around recess 18. End 12*a* of the coil element 12 and ridge 17 are disposed between step portions 13*a* and 13*b* opposite to each other.

Step portion 13*c* is provided in an area that is between slit 14 and slit 15 and that extends in the direction in which end 12*a* of coil element 12 extends. Slits 14, 15, and 16 passes in along step portions 13*a*, 13*b*, and 13*c*, respectively, thereby forming recess 18 easily.

Exemplary Embodiment 3

Figure 8:
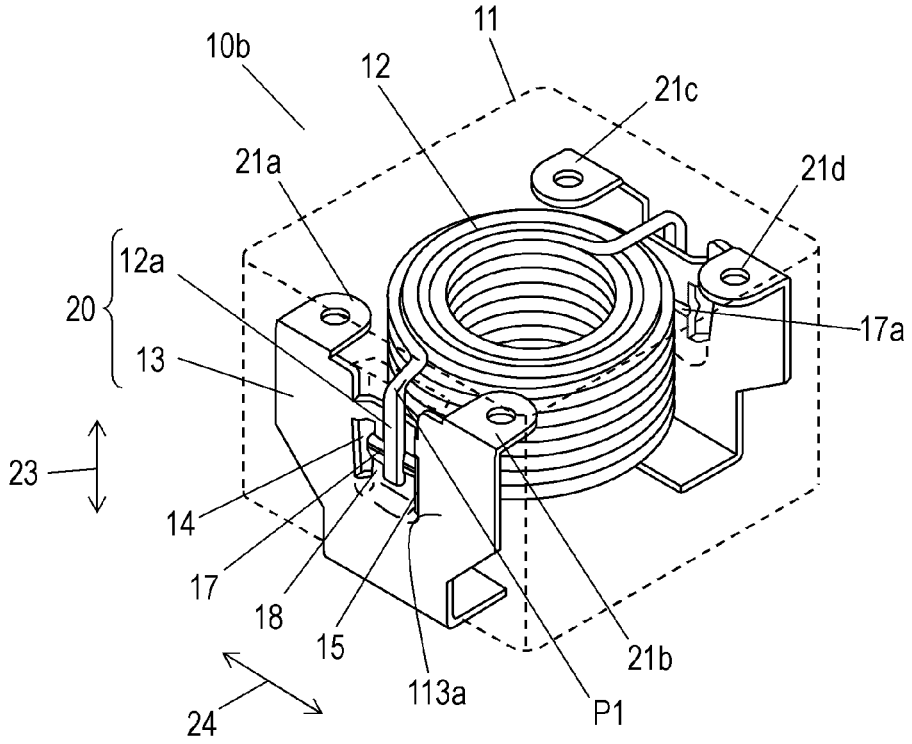
FIG. 8 is a perspective view of a coil component in accordance with Exemplary Embodiment 3.
Figure 9:
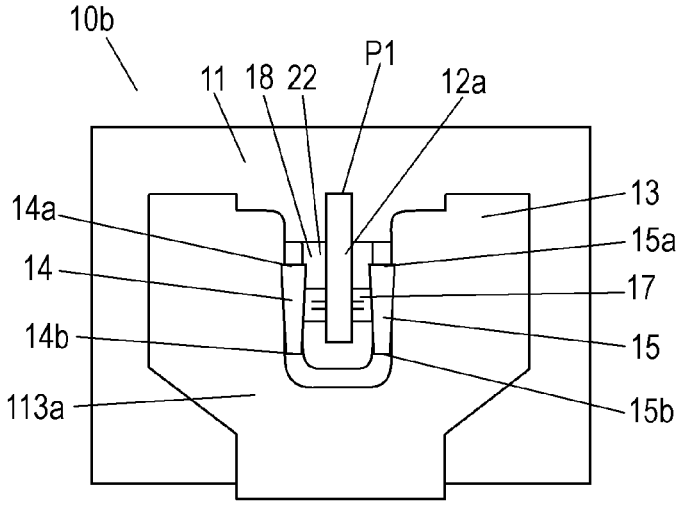
FIG. 9 is a side view of the coil component shown in FIG. 8 for illustrating a retaining member.

FIG. 8 is a perspective view of coil component 10*b* in accordance with Exemplary Embodiment 3. A broken line in FIG. 8 denotes the outline of magnetic core 11. FIG. 9 is a side view of the coil component for illustrating retaining member 13 shown in FIG. 8. In FIGS. 8 and 9, components identical to those of coil components 10 and 10*a* according to Embodiments 1 and 2 are denoted by the same reference numerals. Coil component 10*b* according to Embodiment 3 is different from coil component 10*a* according to Embodiment 2 in that widths of portions of slit 14 and slit 15 in a direction perpendicular to a direction in which slit 14 and slit 15 slenderly extend change depending on the positions of the portions.

The widths of slit 14 and slit 15 in the direction in which slit 14 and slit 15 extend will be described with referring to FIG. 9.

Slits 14 has both end portions 14*a* and 14*b* in direction 23 in which slit 14 slenderly extends. End portion 14*a*, out one of the both end portions, is located close to position P1 (see FIGS. 9 and 3) at which end 12*a* of coil element 12 projects from magnetic core 11. End portion 14*b*, the other of the both ends portion, is located farther from position P1 than end portion 14*a* is. The width of end portion 14*a* is larger than the width of end portion 14*b*. This configuration allows solder to easily enter in slit 14 when retaining member 13 is dipped into the solder, thereby increases the strength of terminal area 20.

That is, slit 14 has end portion 14*a* which has a width larger than that of end portion 14*b*. A distance between end portion 14*b* and position P1 at which end 12*a* of coil element 12 projects from magnetic core 11 is larger than a distance between end portion 14*a* and position P1.

The width of slit 14 increases monotonically from end portion 14*b*, the other of the both end portions, to portion 14*a*, one of the both end portions. This configuration allows solder to enter in slit 14 more easily, thereby increasing strength of terminal area 20.

According to the present embodiment, the width of slit 14 is 0.3 mm at end portion 14*a*, one of the both end portions located close to position P1 at which end 12*a* of coil element 12 projects from magnetic core 11, and the width of slit 14 is 0.2 mm at end portion 14*b*, the other of the both end portions.

Slit 15 has the same shape as slit 14.

That is, slit 15 has both end portions 15*a* and 15*b* of in direction 23 in which slit 15 slenderly extends. End portion 15*a*, one of the both end portions, is located close to position P1 (see FIGS. 9 and 3) at which end 12*a* of coil element 12 projects from magnetic core 11. End portion 15*b*, the other of the both end portions, is located farther from position P1 than end portion 15*a* is. A width of end portion 15*a* is larger than that of end portion 15*b*. This configuration allows solder to easily enter into slit 15 when retaining member 13 is dipped into the solder, thereby increasing strength of terminal area 20.

That is, slit 15 has end portion 15*a* which has a width larger than that of end portion 15*b*. A distance between end portion 15*b* and position P1 at which end 12*a* of coil element 12 projects from magnetic core 11 is larger than a distance between end portion 15*a* and position P1.

The width of slit 15 increases monotonically from end portion 15*b*, the other of the both end portions, to end portion 15*a*, one of the both end portions. This configuration allows solder to enter into slit 15 more easily, thereby increasing strength of terminal area 20.

According to the exemplary embodiment, the width of slit 15 is 0.3 mm at end portion 15*a*, one of the both end portions located close to position P1 at which end 12*a* of coil element 12 projects from magnetic core 11, and the width of slit 15 is 0.2 mm at end portion 15*b*, the other of the both end portions. This configuration allows solder to enter into slit 15 more easily, thereby increasing strength of terminal area 20.

(Method for Manufacturing Coil Component 10 in Accordance with Embodiment 1)

A method for manufacturing coil component 10 in accordance with Embodiment 1 shown in FIG. 2 will be described below.

Figure 10:
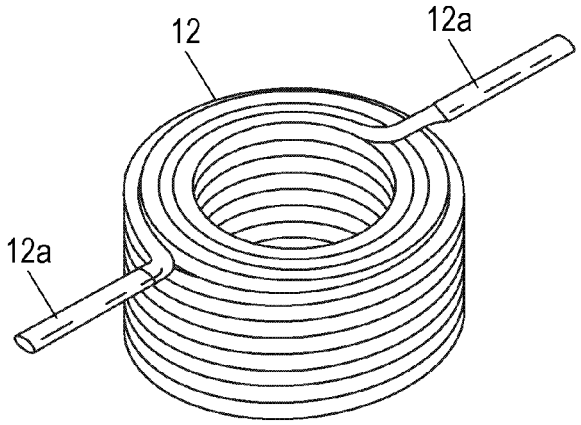
FIG. 10 shows a method for manufacturing the coil component shown in FIG. 2.

FIG. 10 is a perspective view of coil element 12 to be embedded in magnetic core 11 of coil component 10 in accordance with Embodiment 1. As shown in FIG. 10, a copper wire with a diameter of 0.3 mm having a surface coated with insulation is wound helically to provide coil element 12. Two ends 12*a* of coil element 12 extend in directions opposite to each other. The insulation coating end 12*a* of coil element 12 therewith is removed before end 12*a* is electrically connected to retaining member 13. End 12*a* of coil element 12 is pressed to have a flat shape having a thickness in the pressing direction of about 0.2 mm. Since being pressed to have the flat shape, end 12*a* of coil element 12 is prevented from projecting outward from recess 18, thereby preventing overall dimensions of coil component 10 from increasing.

In the case that coil element 12 is made of a copper wire having a small diameter, end 12*a* of coil element 12 may necessarily be pressed.

Figure 11:
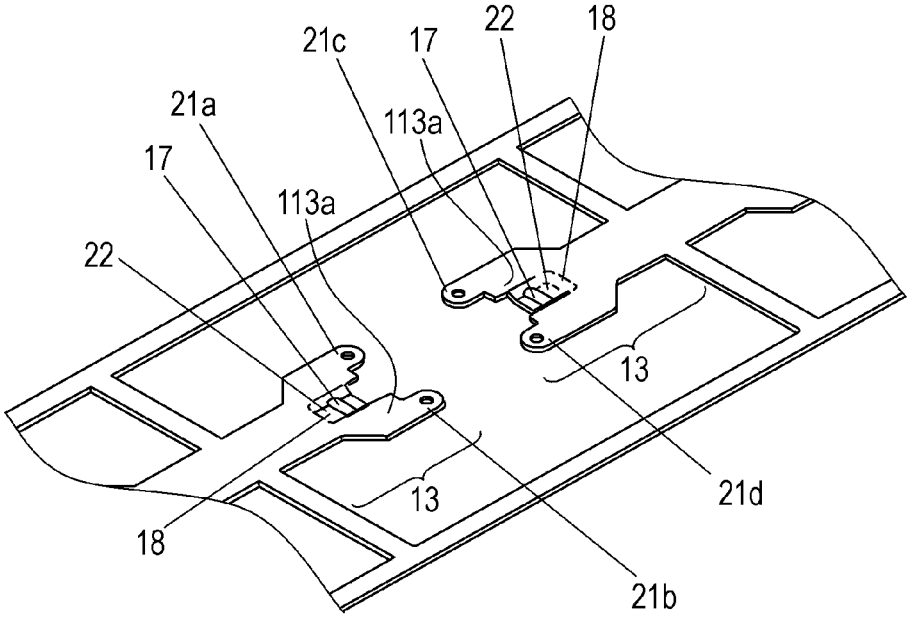
FIG. 11 shows the method for manufacturing the coil component shown in FIG. 2.

FIG. 11 is a perspective view of retaining member 13 connected to a hoop. As shown in FIG. 11, a copper plate is punched by using a die to provide retaining member 13 connected to a hoop. At this moment, retaining member 13 is pressed to form recess 18 sinking from main surface 113*a* of retaining member 13 by a depth of about 0.2 mm. Then, recess 18 is embossed from a back surface of recess opposite to bottom surface 22 to form ridge 17 on bottom surface 22 of recess.

In accordance with Embodiment 1, a height of ridge 17 projecting from bottom surface 22 of recess 18 is 0.1 mm, and ridge 17 has a linear shape which intersects perpendicularly with end 12*a* of coil element 12. Ridge 17 may be formed by pressing simultaneously when recess 18 is pressed.

Groove 17*a* extending linearly (see FIGS. 1 and 2) is formed in a back surface of ridge 17 by the above embossing. Further, two retaining members 13 have respective end portions facing each other. Projecting portions 21*a* and 21*b* are provided at both sides of one of the respective end portions of two retaining members 13. Projecting portions 21*c* and 21*d* are provided at both sides of another of the respective end portions of two retaining members 13. Projecting portions 21*a*, 21*b*, 21*c*, and 21*d* are embedded in magnetic core 11 and fixed when magnetic core 11 is subjected to the second-pressure molding described later.

Figure 12:
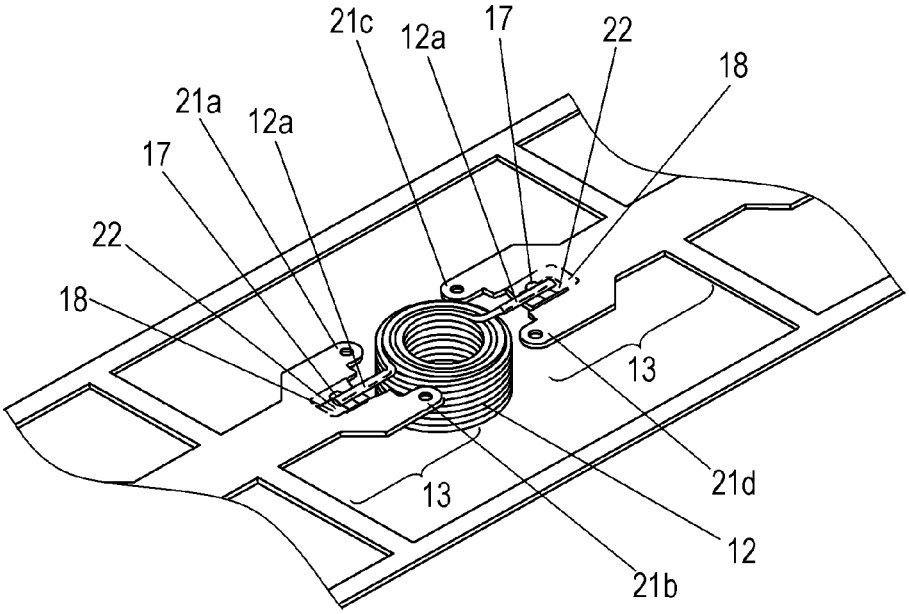
FIG. 12 shows the method for manufacturing the coil component shown in FIG. 2.

FIG. 12 is a perspective view of coil element 12 having end 12*a* fixed to retaining member 13 shown in FIG. 11.

As shown in FIG. 12, end 12*a* of coil element 12 is put into recess 18, and end 12*a* of coil element 12 and ridge 17 cross and are placed on each other. Then, coil element 12 is fixed to retaining member 13 by resistance welding.

Figure 13:
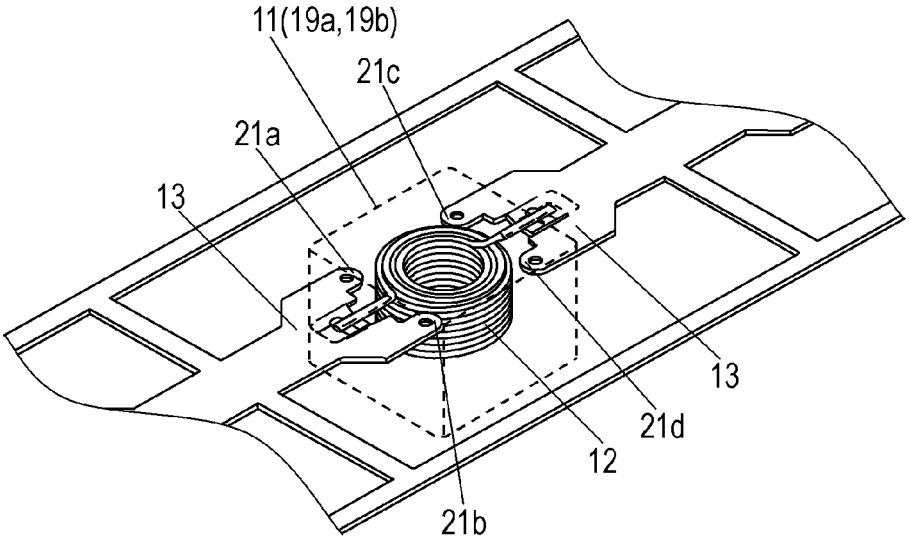
FIG. 13 shows the method for manufacturing the coil component shown in FIG. 2.

FIG. 13 is a perspective view of magnetic core 11 in which coil element 12 and projecting portions 21*a*, 21*b*, 21*c*, and 21*d* of two retaining members 13 shown in FIG. 12 are embedded. In FIG. 13, the outline of magnetic core 11 is denoted by a broken line. A method for manufacturing magnetic core 11 will be described below.

First, binding agent containing thermosetting resin is mixed to metallic magnetic powder to provide mixed material. The mixed material is dried such that the thermosetting resin is not fully cured, and then, crushed into particles to provide magnetic material powder. The magnetic material powder is pressure molded at about 1 ton/cm$^2$ to form pressurized powder body 19*a* and pressurized powder body 19*b* shown in FIG. 1.

Next, pressurized powder body 19*a* is placed on pressurized powder body 19*b* such that coil element 12 and projecting portions 21*a* to 21*d* shown in FIG. 12 are disposed between pressurized powder bodies 19*a* and 19*b*, and then, pressurized powder bodies 19*a* and 19*b* are unified by the second pressure molding. The second pressure molding is carried out at about 5 ton/cm2.

The above processes provides magnetic core 11 denoted by the broken line shown in FIG. 13. Coil element 12 and projecting portions 21*a*, 21*b*, 21*c*, and 21*d* are embedded in magnetic core 11. Subsequently, magnetic core 11 is heat-treated at 180° C. to fully cure the thermosetting resin contained in pressurized powder bodies 19*a* and 19*b*.

Figure 14:
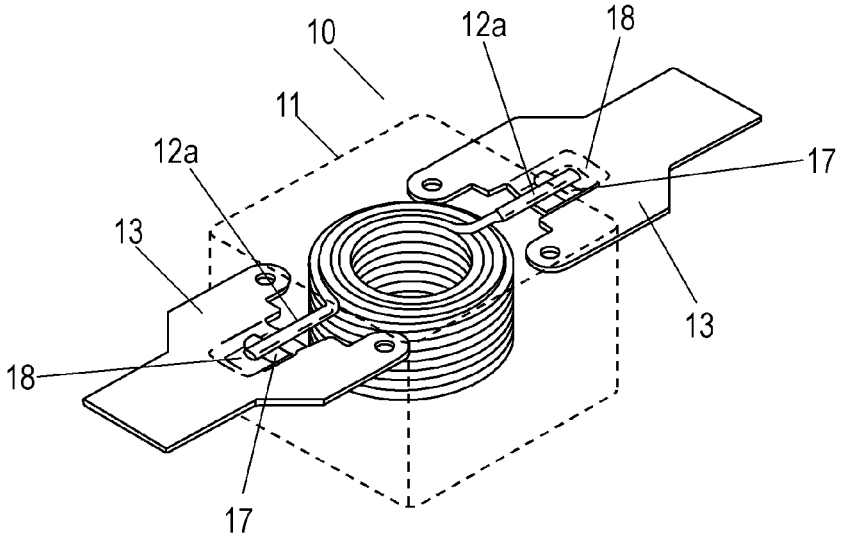
FIG. 14 shows the method for manufacturing the coil component shown in FIG. 2.

FIG. 14 is a perspective view of retaining member 13 after retaining member 13 shown in FIG. 13 is separated from a hoop. A broken line denotes the outline of magnetic core 11.

As shown in FIG. 14, two retaining members 13 fixed to magnetic core 11 are separated from the hoop to provide individual pieces. End 12*a* of retaining member 13 and coil element 12 are coated with a flux and then dipped into solder. As a result, retaining member 13 and end 12*a* of coil element 12 are connected with solder.

The above processes provide coil component 10.

Figure 15:
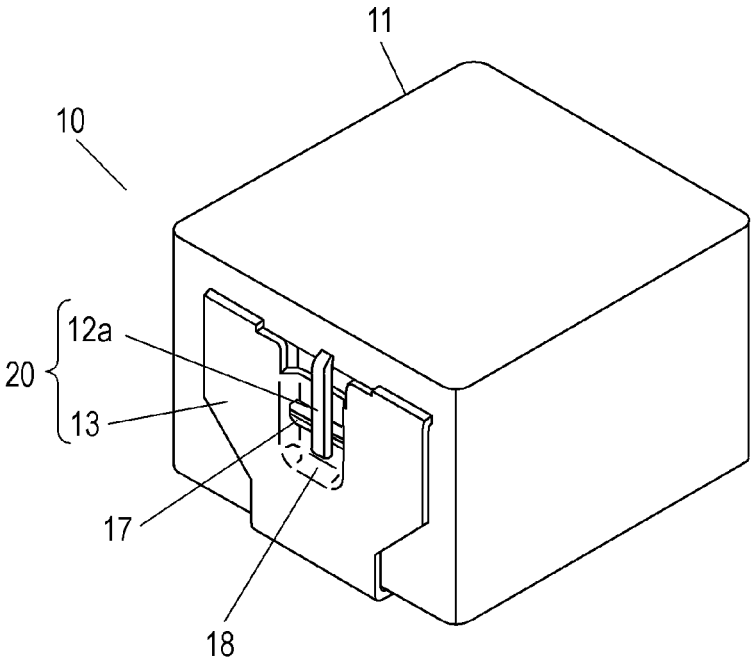
FIG. 15 shows the method for manufacturing the coil component shown in FIG. 2.

FIG. 15 is a perspective view of coil component 10 in which two retaining members 13 shown in FIG. 14 extend along two side surfaces of magnetic core 11, and bent on the lower surface of coil component 10.

As shown in FIG. 15, retaining member 13 which is separated into an individual piece shown in FIG. 14 is cut to have a predetermined length, and the back surface of recess 18 opposite to bottom surface 22 of recess 18 is bent along the side surface of the magnetic core 11.

Then, retaining members 13 are bent toward the lower surface of magnetic core 11 to provide coil component 10 shown in FIG. 15. A recess may be formed in the side surface of magnetic core 11 to have recess 18 of the retaining member 13 fit into the recess.

(Method for Manufacturing Coil Component 10*s* in Accordance with Embodiment 2)

Next, a method for manufacturing coil component 10*a* in accordance with Exemplary Embodiment 2 shown in FIG. 6 will be described below.

A difference between the manufacturing methods according to Embodiments 1 and 2 is that whether a slit is provided in retaining member 13 or not.

Hereinafter, description about the same manufacturing method as Embodiment 1 is omitted.

Figure 16:
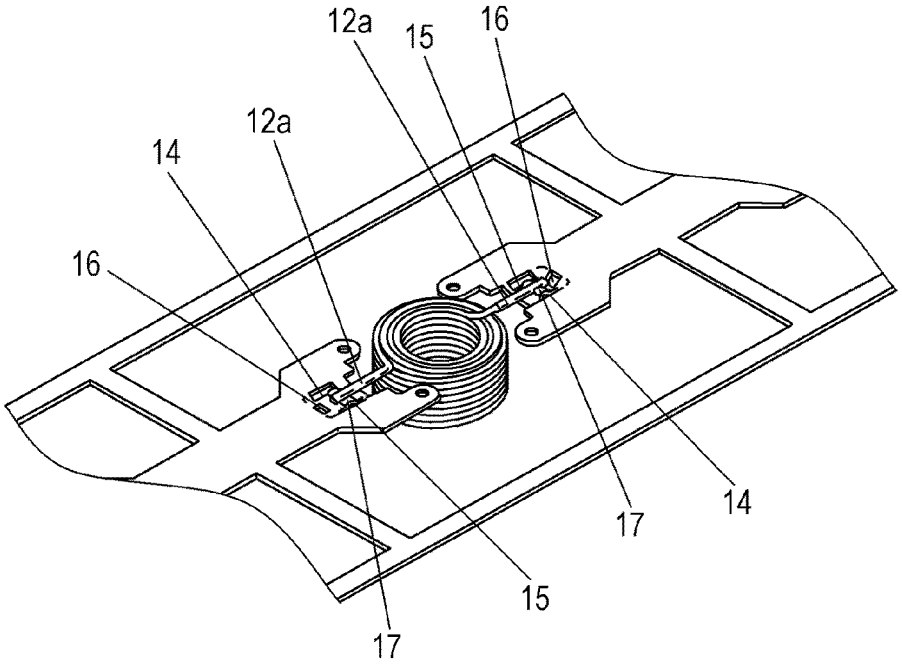
FIG. 16 shows the method for manufacturing the coil component shown in FIG. 6.
Figure 17:
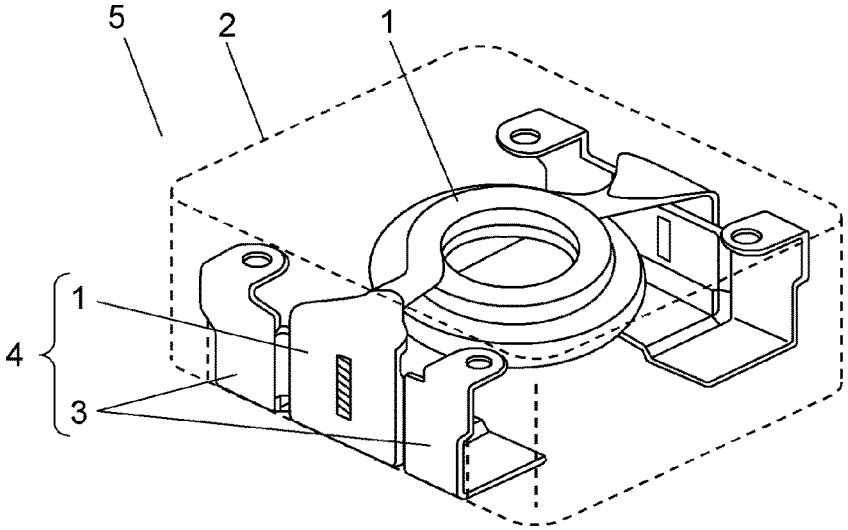
FIG. 17 PRIOR ART
FIG. 17 is a perspective view of a conventional coil component.

FIG. 16 is a perspective view of retaining member 13 having slits 14, 15, and 16 provided in retaining member 13 in FIG. 12.

As shown in FIG. 16, retaining member 13 in accordance with Embodiment 2 has slits 14 and 15 such that end 12*a* of coil element 12 and ridge 17 are disposed between slits 14 and 15. Slit 16 is provided in an area that is between slit 14*s* and 15 and extends in the direction in which end 12*a* of coil element 12 extends.

Slits 14, 15, and 16 are formed by punching retaining member 13 while being connected to the hoop shown in FIG. 11.

As shown in FIGS. 6 and 7, slit 14 is formed in along step portion 13*a*, slit 15 is formed in along step portion 13*b*, and slit 16 is formed in along step portion 13*c*, thereby allowing recess 18 to be formed easily.

In the method for manufacturing coil component 10*a* according to Embodiment 2 shown in FIG. 6, coil component 10*b* according to Embodiment 3 shown in FIG. 8 can be formed by adjusting a slit to be punched in shape suitably when retaining member 13 connected to the hoop is punched.

INDUSTRIAL APPLICABILITY

A coil component in accordance with the present invention can reduce clearance between a die and a retaining member even if having a small size, and is useful as a coil component with high productivity.

REFERENCE MARKS IN THE DRAWINGS

10, 10*a*, 10*b* coil component
11 magnetic core
12 coil element
12*a* end of coil element
13 retaining member
13*a* step portion (first step portion)
13*b* step portion (second step portion)
13*c* step portion (third step portion)
14 slit (first slit)
14*a* end portion (second portion)
14*b* end portion (first portion)
15 slit (second slit)
15*a* end portion (fourth portion)
15*b* end portion (third portion)
16 slit (third slit)
17 ridge
17*a* groove
18 recess
19*a* pressurized powder body
19*b* pressurized powder body
20 terminal area
21*a* projecting portion
21*b* projecting portion
21*c* projecting portion
21*d* projecting portion
22 bottom surface

The invention claimed is:

1. A coil component comprising:

a magnetic core containing magnetic powder;

a coil element embedded in the magnetic core, the coil element having has an end projecting from the magnetic core, the end of the coil element extending in a first direction; and a retaining member for retaining the end of the coil element, wherein the retaining member has a main surface having a recess therein sinking toward the magnetic core, wherein the retaining member has a ridge projecting from a bottom surface of the recess in a predetermined direction and extending linearly along the bottom surface in a second direction, wherein the end of the coil element contacts a tip end portion of the ridge in the predetermined direction, and the end of the coil element is welded to the ridge at the tip end portion of the ridge, and wherein the first direction and second direction intersect with one another.

2. The coil component according to claim 1, wherein the ridge is provided in the recess.

3. The coil component according to claim 1, wherein the retaining member has a first slit and a second slit arranged such that the end of the coil element and the ridge are provided between the first slit and the second slit.

4. The coil component according to claim 3, wherein the recess has a first step portion and a second step portion which are connected to the main surface of the retaining member and the bottom surface of the recess, wherein the first slit passes in along the first step portion of the recess, and wherein the second slit passes in along the second step portion of the recess.

5. The coil component according to claim 3, wherein the first slit has a first portion and a second portion, the first portion of the first slot having a first width, the second portion of the first slit having a second width larger than the first width, wherein a distance between a position at which the end of the coil element projects from the magnetic core and the first portion of the first slit is larger than a distance between the position and the second portion of the first slit, wherein the second slit has a third portion and a fourth portion, the third portion of the second slit having a third width, the fourth portion of the second slit having a fourth width larger than the third width, and wherein a distance between the position and the third portion of the second slit is larger than a distance between the position and the fourth portion of the second slit.

6. The coil component according to claim 5, wherein the first portion of the first slit includes one of both ends of the first slit, and the second portion includes another of the both ends of the first slit, wherein a width of the first slit monotonically increases from the first portion to the second portion of the first slit, wherein the third portion of the second slit includes one of both ends of the second slit, and the fourth portion includes another of the both ends of the second slit, and wherein a width of the second slit monotonically increases from the third portion to the fourth portion of the second slit.

7. The coil component according to claim 3, wherein the retaining member has a third slit between the first slit and the second slit, the third slit extends in a direction in which the end of the coil element extends.

8. The coil component according to claim 7, wherein the recess has a step portion connected to the main surface of the retaining member and the bottom surface of the recess, and wherein the third slit passes in along the step portion of the recess.

9. The coil component according to claim 1, wherein the predetermined direction is substantially perpendicular to the bottom surface of the recess.

10. A method for manufacturing a coil component, comprising:

providing a coil element including a wound lead wire having an end, the end of the coil element extending in a first direction;

providing a retaining member made of a flat metal plate having a recess therein, the retaining member having a ridge projecting from a bottom surface of the recess in a predetermined direction and extending linearly along the bottom surface in a second direction;

disposing the retaining member and the coil element such that a tip end portion of the ridge in a predetermined direction contacts the end of the coil element;

welding the tip end portion of the ridge with the end of the coil element; and pressure molding a magnetic core made of a magnetic material while the coil element is embedded in the magnetic core, wherein the first direction and the second direction intersect with one another.

11. The method according to claim 10, further comprising bending the retaining member.

12. The method according to claim 10, wherein the retaining member has a first slit and a second slit arranged such that the end of the coil element and the ridge are disposed between the first slit and the second slit.

13. The method according to claim 12, wherein the first slit passes in along a first step portion of the recess connected to the main surface of the retaining member and the bottom surface of the recess, and wherein the second slit passes in along a second step portion of the recess connected to the main surface of the retaining member and the bottom surface of the recess.

14. The method according to claim 12, wherein the retaining member has a third slit between the first slit and the second slit, the third slit extending in a direction in which the end of the coil element extends.

15. The method according to claim 14, wherein the third slit passes in along a third step portion of the recess connected to the main surface of the retaining member and the bottom surface of the recess.

16. The method according to claim 10, wherein the predetermined direction is substantially perpendicular to the bottom surface of the recess.

* * * * *